United States Patent [19]

Mosele et al.

[11] Patent Number: 5,010,336

[45] Date of Patent: Apr. 23, 1991

[54] TEMPORARY TRAFFIC LIGHT CONTROL

[75] Inventors: John L. Mosele, Northfield; Lars O. Stolpe, Evanston, both of Ill.

[73] Assignee: Jelp, Inc., Northfield, Ill.

[21] Appl. No.: 388,244

[22] Filed: Aug. 1, 1989

[51] Int. Cl.[5] ..... G08G 1/95; G08G 1/97

[52] U.S. Cl. ..... 340/907; 340/908; 340/931; 340/693; 340/333; 340/815.15; 340/815.21

[58] Field of Search ..... 340/907, 908, 931, 693, 340/333, 912, 930, 815.21, 815.15

[56] References Cited

U.S. PATENT DOCUMENTS

| | | | |
|---|---|---|---|
| 3,641,487 | 2/1972 | Rogers et al. | 340/931 |
| 3,895,345 | 7/1975 | Elvers et al. | 340/907 |
| 4,510,549 | 4/1985 | Tedesco | 340/931 |

*Primary Examiner*—Donnie L. Crosland

*Attorney, Agent, or Firm*—Myers & Associates, Ltd.

[57] ABSTRACT

An auxiliary traffic light which has a strobe light clamped on the primary bulb in axial alignment therewith so to obtain maximum reflection characteristics from a reflector behind the primary bulb. A primary circuit is provided for lighting the bulb and the strobe light being connected to a battery operated circuit for flashing the strobe upon failure of the power source.

15 Claims, 3 Drawing Sheets

TEMPORARY TRAFFIC LIGHT CONTROL

BACKGROUND OF THE INVENTION

This invention relates to traffic signal devices in which all auxiliary light is provided upon power failure incapacitating the primary light.

DISCUSSION OF THE PRIOR ART

Various attempts have been made to provide an adequate temporary light assembly such as:

In U.S. Pat. No. 3,641,487 a substitute neon tube is used encircling the primary bulb. This is not only costly but also shield the reflector.

U.S. Pat. No. 3,509,358 illustrates a pulse generator which incorporates various mechanical means for generating the pulse.

U.S. Pat. No. 4,401,969 uses a battery supplement in a circuit in the event of failure of a primary signal light.

U.S. Pat. No. 4,283,657 illustrates an exit illuminating device.

U.S. Pat. No. 4,422,069 discloses an alarm circuit for a fire detector, and

U.S. Pat. No. 3,336,574 shows a circuit for alarming a central station of the failure of a traffic light control.

SUMMARY OF THE INVENTION

This invention is directed to a traffic control circuit of simplified form which is easily mounted in the housing and providing a strobe light in a position approximating the location of the primary light bulb so as to obtain approximately the reflective characteristics of the parabolicreflector behind the primary bulb.

The invention is directed to providing an auxiliary light source for a red or yellow traffic light attendant to power failure extinguishing all of such lights.

The invention contemplates providing a flashing substitute traffic light in a stoplight housing in a position where a driver normally expects to see the traffic signal.

The invention provides a small, relatively inexpensive assembly that readily and quickly installs in conventional stop light housing.

Another object is to provide a system which operates automatically and thus eliminates the need for police or other municipal employees to arrive on the scene to hang signs or direct traffic.

The invention provides one red or yellow signal and eliminates the installation of costly wiring such as needed for devices utilizing auxiliary bulb s controlled from a main controller.

One object of the invention is to provide a device adaptable for easy mounting in the conventional housing of a standard traffic light assembly.

A primary object of the invention is to provide an auxiliary traffic light device which includes a sensor adapted to sense voltage in the primary circuit operating the conventional lights, and which upon power failure occurring in the primary circuit, switches the device to a battery operated mode which flashes the red or yelloW sections of the conventional light.

These and other objects and advantages of the invention will become more readily apparent from the specification and drawings, wherein.

DESCRIPTION OF THE INVENTION

MECHANICAL DESCRIPTION

Figure 1:
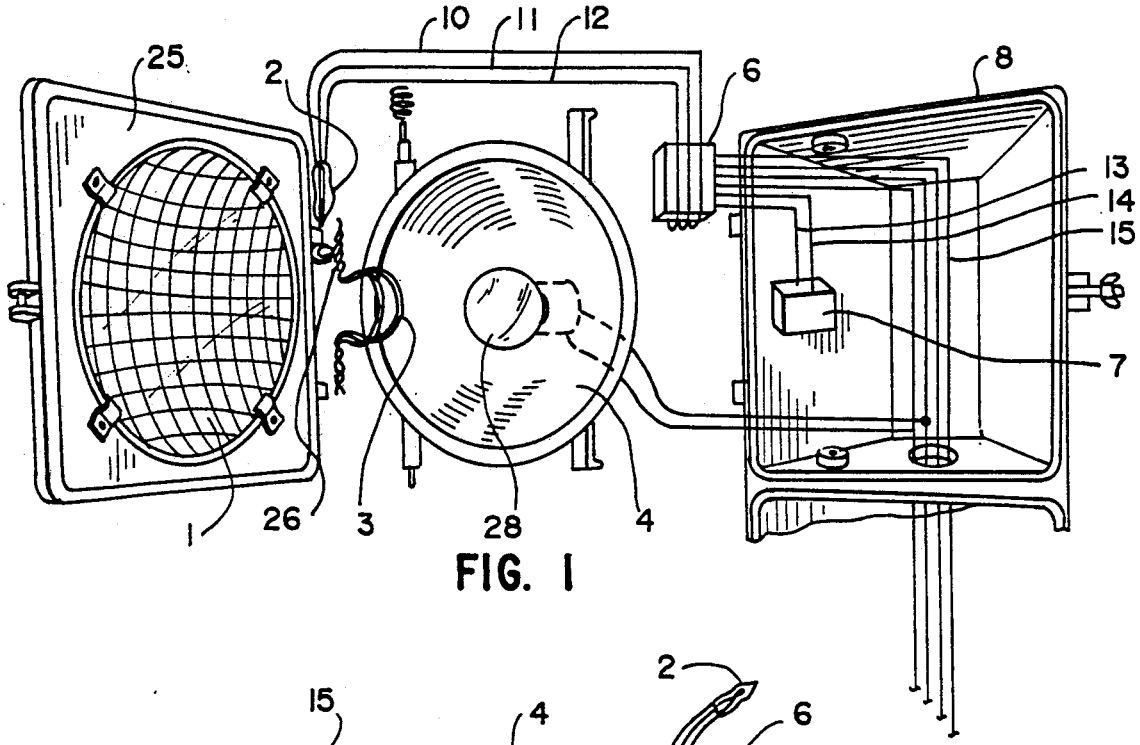
FIG. 1 is a exploded view of the invention.
Figure 2:
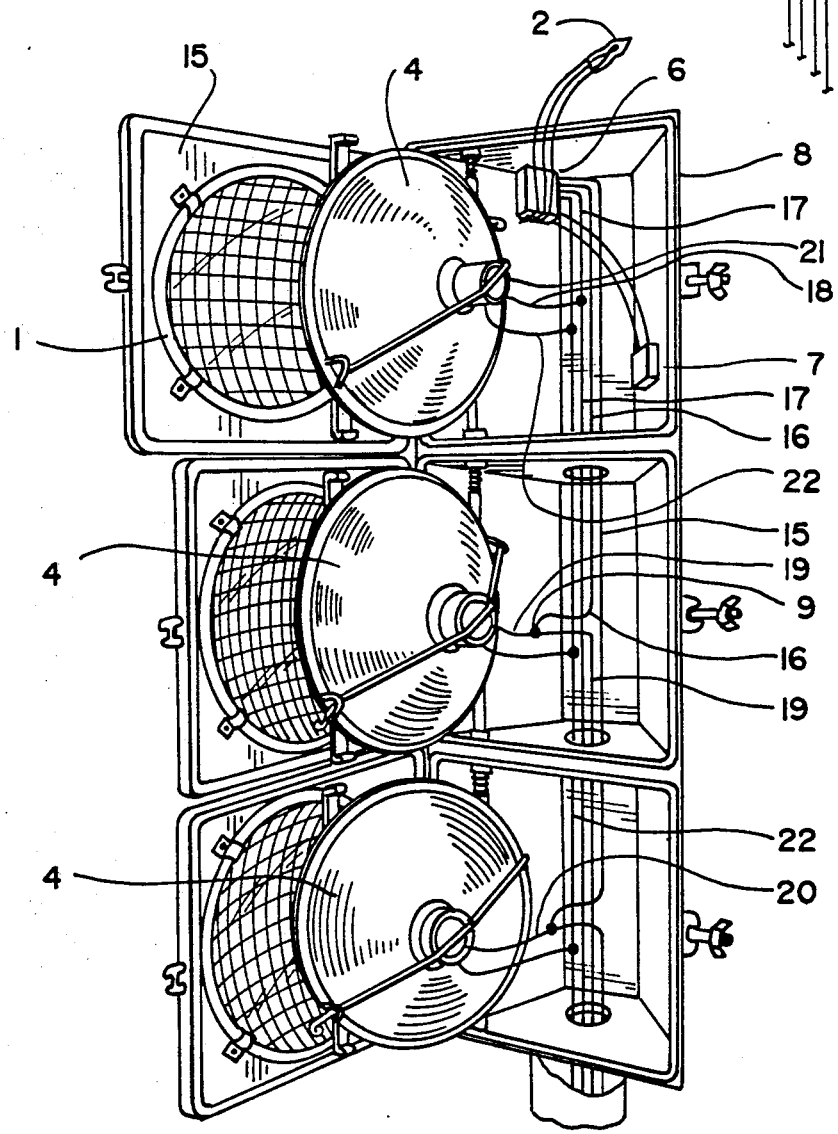
FIG. 2 is a side elevation showing a three lamp traffic light arrangement.
Figure 3:
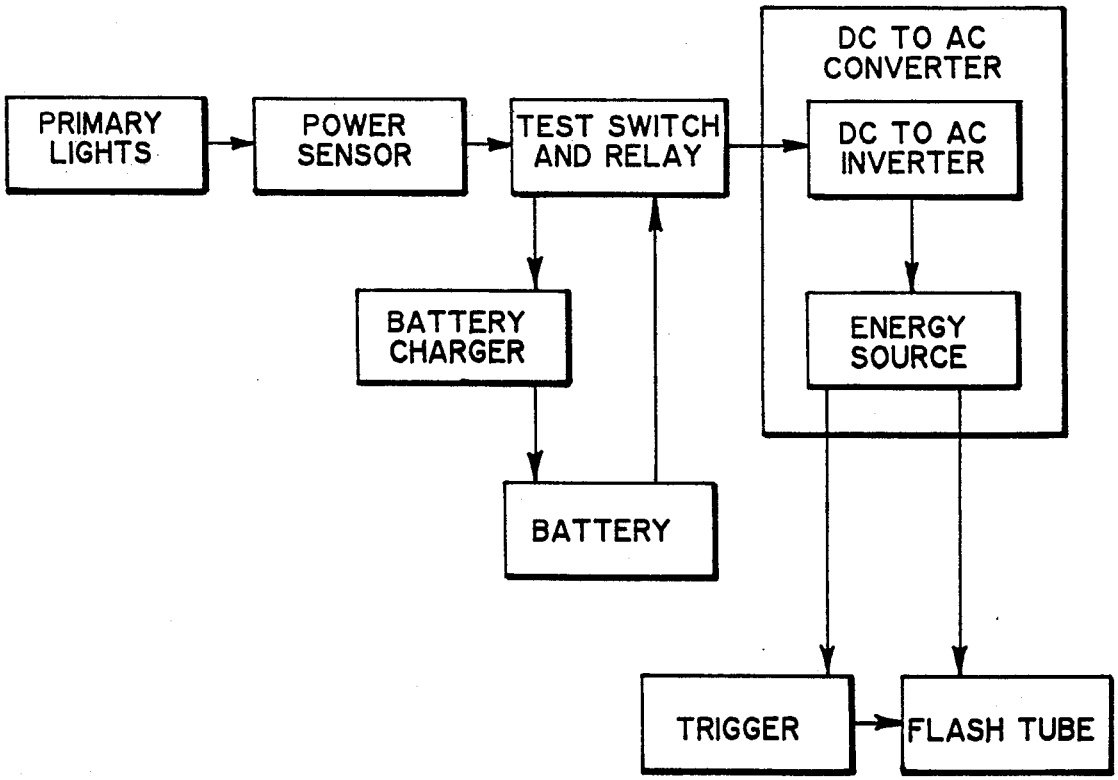
FIG. 3 is a diagram of the device.
Figure 4:
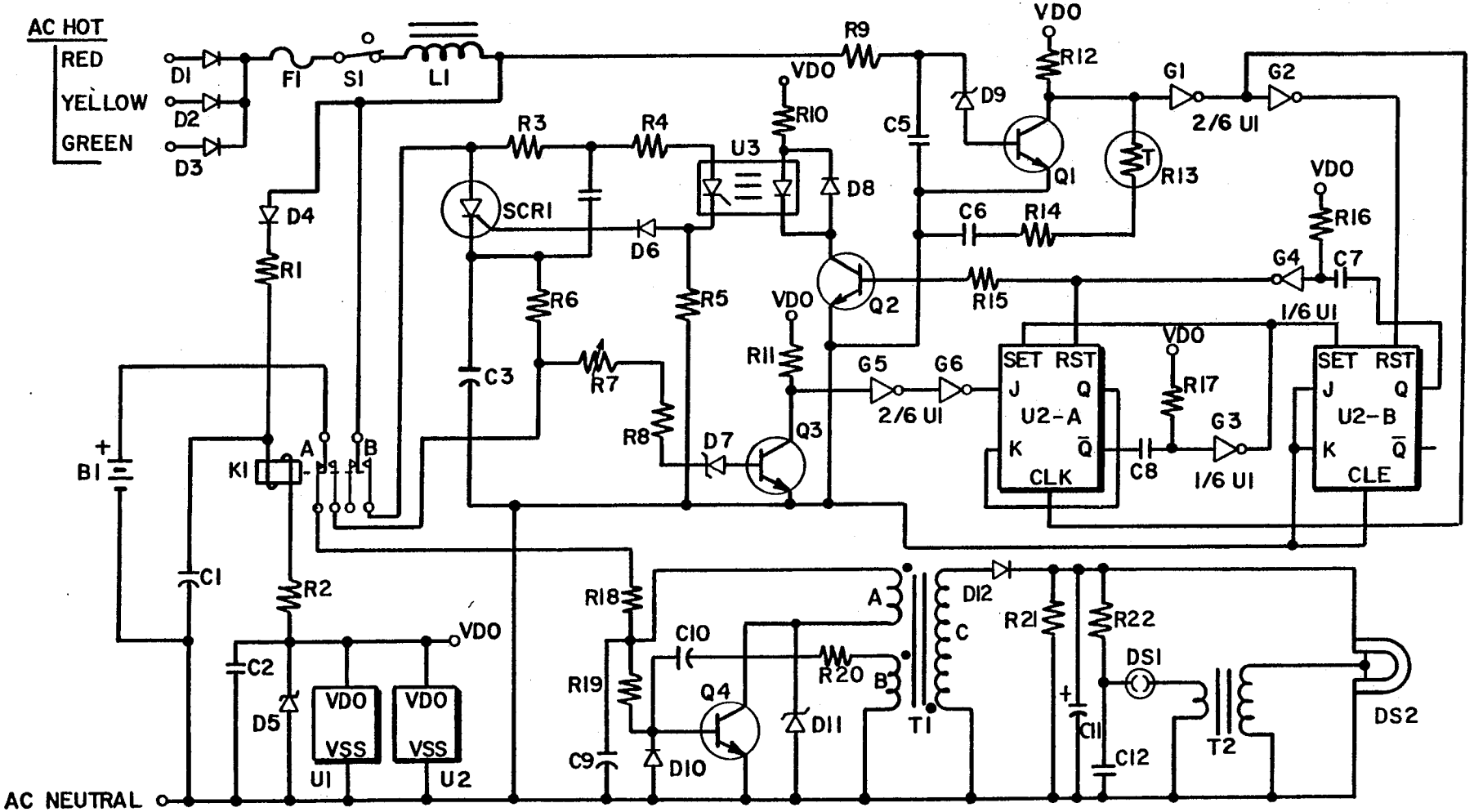
FIG. 4 is a schematic diagram of the device.

This description refers to figures one and two.

This device consists of an enclosure (6) containing all the circuitry except for the battery (7) and the xenon lamp flash (2). The xenon lamp is connected to the circuitry by three wires (10, 11 and 12) and is placed between the red lens, (1) mounted on the hinged cover plate (25), and the existing incandescent bulb (28). It is held in that position in a loop (26) formed in a wire holder (3) clamped about the incandescent bulb (28). It is essential that the flash lamp tube is located in a centered position with respect to the parabolic reflector (4). This use of a xenon tube clamped to the primary bulb 28 is to ensure the maximum use of the parabolic reflector 4 and minimum obscuration of the primary bulb 28 and reflector lens 1. The battery (7) is connected to the flash circuitry via two wires (13 and 14) using quick connect terminals.

The battery and the circuitry enclosure are placed in the rear of the stoplight housing (8) behind the reflector. These two items are attached to the stoplight housing using self-adhesive hook and loop strips or double-sided tape. Three of the four coded sensing leads (15, 16 and 17) of the flash circuitry are connected to the three hot stoplight leads (18,19 and 20) using self-stripping connectors (9). The fourth sensing lead (21) is similarly connected to a neutral stoplight lead (22). An alternative method of electrical hook-up of the four sensing leads would employ terminals connected directly to the terminal block found in one of the stoplight housings. In situations employing less than three primary lights, the unused sensing leads can be connected together with lead (18) or left unconnected.

OPERATIONAL DESCRIPTION

This description refers to the block diagram. When there is power to any one or all of the primary lights the power sensor rectifies that AC voltage holding the DC relay in its energized position. In this state the relay connects the battery to the battery charger. The battery charger receives power through the power sensor and the relay. Included in the relay circuitry is a delay. This keeps the relay energized for a few seconds after AC power is removed, enabling the device to be used with stoplights set for repetitive flashing of only one light. The test switch disconnects the contact relay and the battery charger so that proper operation of the device can be checked.

When power to the stoplight is interrupted, or if the test switch is opened, the relay is released into its normal state. The relay removes the battery charger from the circuit and connects the battery to the DC to DC converter. The first stage of the converter is essentially a DC to AC inverter. The inverter oscillates battery voltage producing a stepped up oscillating voltage at its output. This voltage is rectified and builds up in the energy storage capacitor. Thus, at the output of the DC to DC converter exists an increasingly larger DC voltage. When this voltage reaches the trigger's threshold value, the capacitor discharge trigger applies power to the flash tube, turning it on. The flash tube drains the energy storage of its useful energy, converting this energy to a momentary but extremely bright flash of light. The converter begins refilling the energy storage.

This cycle keeps repeating itself until battery voltage is removed from the converter.

The time interval between flashes is equal to the time required for the converter to fill the energy storage capacitor to the trigger's threshold value. This is, in part, a function of battery voltage. As the flash unit uses energy from the battery, the potential energy (voltage) of the battery is lowered. This gradual lowering of battery voltage increases the time needed to refill the energy storage. Thus the frequency of flashing is also reduced. However, this does not affect the brightness of the flash. The amount of energy stored in the energy storage (preset by component values) is what determines the duration/intensity of the emitted light. In this manner a flash of consistent brightness can be produced as long as the battery contains enough energy to power the converter.

ELECTRICAL DESCRIPTION

This description refers to the schematic, schematic parts list and block diagram.

POWER SENSOR

The power sensor consists of the rectifying diodes D1--D3.

Any one of the three diodes will be conducting as long as power is available to the stoplight (assuming proper installation of the device). The reverse voltage blocking characteristics of these diodes prohibit line voltage intended for one control light to be applied erroneously to another control light while still delivering half-wave rectified line voltage to the device.

Ideally, fuse F1 would be connected directly to line voltage instead of the sensing diodes. This would require three separate in-line fuses. To avoid possible conflict of control voltages, the current handling rating of D1, D2 and D3 far exceed that of the fuse.

TEST SWITCH AND RELAY

This section includes: test switch S1, relay K1, diode D4, capacitor C1 and resistor R1. Test Switch S1 is normally closed. Opening S1 results in poWer from the sensors not reaching the relay, activating the flash unit. This is used to verify the operation of the flash unit. At all other times S1 is left closed, feeding the relay with half-wave rectified voltage and keeping the unit deactivated.

The only exception to this would be a flashing stoplight. Given that the off cycle is less than a few seconds, the voltage pulses causing the stoplight to flash supply enough power to delay/filter capacitor C1 to keep relay K1 continuously energized.

If it is not energized, the normally closed contacts of K1's A pole connect the battery, B1 to the flash unit. As long as K1 is energized, its normally open contacts are closed. The A pole now connects the battery to the battery charger, the B pole supplies power to part of the battery charger.

Resistor R1, in line with K1, serves to drop the rectified line voltage to the lower DC voltage required by the relay. Diode D1 is needed to prevent C1 from discharging into the battery charger. This not only extends the delay but because of its magnitude, the charge on C1 would interfere with proper functioning of the battery charger.

Further in line with K1 are a few components that are part of the battery charger. Their placement here have three major reasons. Primarily it reduces the amount of line voltage that has to be burned off by heat generating resistors. Both the relay and a section of the battery charger require a low DC voltage. Next, it increases the resistance of the RC network governing the time delay, increasing the delay. This could also be accomplished in a parallel set up at the expense of additional heat generating resistance. Finally, it provides additional filtering for the low DC voltage (Vdd) required by the charger.

DC TO DC CONVERTER

The actual flash unit is broken into three subsystems. The first one of these, the DC to DC converter is further separated into two parts; the DC to AC inverter, consisting of: resistors R18–R20, capacitors C9–C10, diodes D10–D11, transistor Q4 and transformer T1; and the energy storage, consisting of: capacitor C11, diode D12 and resistor R21.

Although the inverter is not the traditional two transistor push-pull type, it functions very similarly. Operating at relatively high frequency, Q4 switches off and on driving the core of T1 in and out of saturation. This method of high frequency oscillation is used in two-transistor inverters to reduce the size of the transformer; increased frequency on a coil increases its inductive reactance, minimizing the physical size of the magnetic core and the number of windings needed for the equivalent reactance of a lower frequency. The end result is a smaller transformer.

Although it is not unique in this respect, this inverter design takes transformer size reduction further. By not using a second transistor, only one primary and one tertiary winding are needed. Again, this nets a smaller transformer.

Upon initial application of battery voltage to the flash unit, current flows through current limiting resistor R18 charging tank capacitor C9 close to battery voltage. This current also flows through base resistor R19 charging capacitor C10. The voltage on C10 is present on the base emitter junction of switching transistor Q4 as Vbe. When Vbe becomes large enough, Q4 turns on creating a current path through the transformer's primary winding T1-A. Current builds up on the primary winding until the car of T1 reaches saturation. At this point the inductance of the core drops to a very low value incapable of impeding the voltage across the primary of T1 as well as the voltage built up on its tertiary winding, T1-B, via C10 and R20. This lowers Vbe, turning Q4 off and stopping current flow through the primary windings. This deceleration of current flow through the primary winding causes the induced voltage in the transformer to change polarity, reversing current flow. The circuit then reaches a state similar to when first energized. The cycle repeats itself but the sWitching is aided by the induced reverse voltages.

This reversal of current through the primary windings, caused by the application of battery voltage and the subsequent generation of self induced voltage, sets up an oscillating voltage on the secondary windings (output) of T1.

The amplitude and frequency of this oscillating (alternating) voltage is load dependent, the load resistance appears as reflected impedance to the oscillator on the input side of T1. A large load, such as the short circuit equivalent of an uncharged capacitor causes the amplitude and the frequency of the oscillator, and therefore entire inverter, to be low. With each cycle the energy storage capacitor C11 gradually charges up. Diode D12 rectifies the generated AC output, keeping C11 from discharging through the output windings of T1. As C11 charges up, it reflects an increasing impedance (decreasing load) to the input oscillator. The input oscillator in turn oscillates at a higher frequency, creating an AC voltage of increasing amplitude at the output of the inverter. In this manner the energy storage is charged with a high voltage. When the flasher is deactivated, any voltage stored on C11 is bled off by R21.

In the absence of a second set of transistor and primary/tertiary windings mirroring the existing set, are D10 and D11. In the two-transistor push-pull inverter the induced voltages would be fed through these missing components. In this design diodes D10 and D11 clamp these generated voltages. Specifically, D10 allows current flow around the base emitter junction of Q4 protecting it from excessive reverse voltage. Similarly, zener diode D11 protects Q4 by clamping the induced voltage across the collector-emitter of the transistor.

TRIGGER AND DISCHARGE LAMP

The increasing DC voltage of C11 (energy storage) is directly across the trigger circuitry consisting of: resistor R22, capacitor C12, argon trigger lamp DS1 and trigger transformer T2; and the discharge xenon flash lamp DS2.

The trigger has a break-over point determined by the voltage rating of DS1. When the voltage from the converter hits this point, DS1 "breaks" into conduction. DS1 is referred to as a lamp because at this instance it emits a brief flash of concealed light. More importantly, it conducts a floW of current through the primary winding of T2, inducing a momentary pulse of a few thousand volts across the output windings of T2.

This large voltage is applied to the anode of DS2, exciting the gas inside the tube of DS2 into a conductive state. The relatively large potential energy of C11 is now absorbed by the gas which converts this energy into light. If C11 were an unlimited supply of energy, this light would be constant until the gas breaks down (bulb burns out). However, the energy stored in C11 is quickly depleted to a level too low to sustain this potential energy to light energy conversion. The visible light is therefore only a brief flash of light occurring every time the trigger's threshold voltage is regenerated.

Keeping in mind that the output of the DC to AC inverter is indeed an alternating voltage with peak voltages occurring every cycle of oscillation that are greater than the rectified DC average on C11. These peaks reach trigger threshold voltage before C11 has charged to this level. R22 and C12 filter out these peaks so as to avoid premature triggering.

BATTERY CHARGER

The battery charger consists of all parts not previously covered. It is essentially a switching type power supply with a phase controlled pulse output. It uses a thyristor, SCR1, with tighter control signals than usually encountered. These signals have to be tighter than normal due to the limited separation of the battery from line voltage.

A switching power supply is capable of providing power to its load without generating excess heat. In this application, where the incandescent stoplight bulb is generating heat approaching the limit of what the stoplight housing can dissipate, this is an important concern. A step down transformer capable of delivering a substantial amount of power would not only be impractical due to the limited amount of space available, but in order to use the very simple sensing device used, would not be electrically possible.

A thyristor was chosen because of its high current handling abilities per package size and cost. Phase control with thyristors is often accomplished with a very simple RC network delaying the gate (trigger) signal of the thyristor. Due to the electrical characteristics of thyristors, this method relies on either a fixed load and/or a variable RC network to achieve the desired delay. Since a battery represents a varying load depending on its state of charge, this method leaves a firing range that is too broad to be used in this application.

In addition, the exact triggering of thyristors is made less predictable with variations of ambient temperature. Since the installation of this device will cover an extremely broad range of ambient temperatures, further demands are placed on the precision of triggering the thyristor.

To ensure this precision, digital logic circuitry was used to pinpoint the triggering point of SCR1. Resistor R2, capacitor C2 and zener diode D5 provide the operating voltage, Vdd, for the logic circuitrY. SCR1 is connected to line voltage via the normally open contacts of the B pole of K1 and hash choke L1. In this manner, any scrambled poWer up signals from the logic circuitry that would cause SCR1 to trigger erroneously will not connect line voltage to the battery since Vdd and associated signals are stabilized before the relay is energized, a result of K1 and Vdd being connected in series. Hash choke L1 limits the surge current when SCR1 is fired. This reduces the amount of heat produced by the components in line with SCR1.

When the logic circuitry sends a signal, transistor Q2 turns on, turning on the light emitting diode of optocoupler U3. The SCR output of U3 then turns on, sending current to the gate of SCR1, turning it on. SCR1 now conducts for the remainder of the positive half of the sinusoidal line voltage. With SCR1 conducting, capacitor C3 charges to a voltage greater than battery voltage and some line voltage is fed to the battery via resistor R6 and K1. Prior to the zero crossing point of this one cycle of line voltage, SCR1 stops conducting but C3 is still discharging through R6 to the battery. C3 therefore increases total current flow to the battery.

R3-R5, and D6 and C4 serve to lessen the instantaneous applied Voltage (dv/dt) that may cause undesired turn on of either SCR. Excessive dv/dt may occur when the stoplight's controller switches between lights while line voltage is at its cyclic peak. This would create a problem for the charger particularly if the stoplight is set for frequent switching, as in a flashing mode. R3, R4 and C4 reduce the amount of dv/dt while D6 prevents reverse current through the gate of SCR1. If it were not for R5, D6 would not be required. Thyristors exhibit a small amount of leakage current While in the off state. The leakage current of the output SCR in U3 coupled with excessive heat and/or dv/dt can cause SCR1 to conduct inadvertently. R5 avoids this by holding U3's output at a lower voltage than the output of SCR1.

Given this situation Where R5's need necessitates the use of D6, U3 could be a triac output rather than an SCR output optocoupler as shown on the schematic. This is reflected in the enclosed parts list. In either case, R10 limits the current from Vdd through U3's input diode while D8 protects it from excessive reverse voltage.

The logic circuitry of the charger is comprised of two CMOS integrated circuit chips. Not only can Vdd be simple due to the low power consumption of this family of digital ICs, but since they operate at a wide range of supply voltages, lower tolerance components can be used and they will still function if Vdd drifts down below its set value, as is the case of a pulsed line voltage situation.

There are three interfaces between the logic circuitry and the rest of the battery charger, two input and one output. These are bipolar switching transistors Q1-Q3. Output transistor Q2, as already mentioned, triggers the SCR when it turns on. This occurs when the output of U1's gate 4 (U1-G4) is high.

The voltage of U1-G4 in a high state puts current through current limiting resistor R15, supplying Q2 with base current for turn on.

The rest of this logic/interface description is aided by the enclosed (timing diagram. Q1 is the interface to line voltage. This is done by zener diode D9 controlling line current through R9 to the base of Q1. At voltages below the voltage rating of D9 it does not conduct. With no base current applied, Q1 is an open switch whose collector is held at Vdd by R12. This represents a logical high at the input of U1-G1. At line voltages above D9's rating, D9 conducts base current for Q1, bringing its collector voltage neaz Vss (negative supply voltage of the CMOS circuits) and representing a logical low at the input of U1-G4.

Q3 serves as the interface to the battery level. The logic level conversion of the voltage at its collector is accomplished in the same manner as that of Q1 via R11. Base drive of Q3 occurs When the battery has reached its charged level. Current flows through calibrating poteniometer R7 and resistor R8 only after battery voltage has reached the voltage rating of zener diode D7. The biasing of Q3 is set to turn on at the low end of D7's conduction point, a very small amount of current from the battery is therefore used to indicate a charged condition. As a result, the voltage at the collector of Q3 will not always represent a true or perfect CMOS logic level but it will be a true high signal if battery level is well below desired. It will also be a true low signal when the battery is solidly charged. To compensate for the in between stages, the voltage at Q3's collector is buffered through the Schmitt trigger of U1-G5 and re-inverted by U1-G6.

The output of U1-G1 directly drives the clock of U2-A. Changes in the clock occur at the transition point of line voltage crossing D9's rated voltage. On the upswing of line voltage, battery level status is clocked into the J input of U2-A. A high state on the J input sets flip-flop A of U2, causing Q' of U2-A to go low. Components C8, R17 and U1-G3 are configured as a negative edge triggered positive pulse generator, which is now triggered. The positive pulse output of U1-G3 sets the flip-flop of U2-B, output Q is now high.

The output of U1-G2 goes high at the downswing of line voltage crossing D9's rated voltage, resetting U2-B. At the Q output of this flip-flop is another negative edge triggered positive pulse generator (C7, R16 and U1-G4) with a duration of about one mS. When U2-B's Q is brought low, this pulse causes SCR triggering as well as resetting U2-A for the next cycle. If the battery is charged, a low level signal is clocked into U2-A. Since there is no change in the state of U2-A, none of the pulses required for SCR triggering occur, keeping SCR1 off.

Because of tolerances in component values the exact firing point will vary, creating variations of the average current to the battery through R6. This varies the power dissipated in the form of heat energy by R6. Extreme variations of ambient temperature will also occur. A method of avoiding excessive heat build-up is to limit the amount of internal heat generated with a delay of SCR triggering. Thermistor R13, compensation resistor R14 and capacitor C6 form a variable delay of Q1's collector voltage reaching Vdd after Q1 has been turned off. At cooler temperatures, R13 is much larger than R12 causing an instantaneous voltage division with the input of U1-G1 being much closer to Vdd than Vss. This results in a high logic level input With minimal delay. At higher temperatures R13 becomes smaller than R12. Now the voltage divider requires partial charging of C6 to deliver a high logic signal at the input of U1-G1. The higher the temperature, the smaller R13 becomes. This would provide for a faster charging of C6 but it is the combination of an RC delay and voltage divider that provides adequate delay for the reset signal of U2-B that triggers the SCR firing pulse.

Since the logic is clocked by the oscillations of line voltage, any deformations of line voltage would interfere with its proper operation. These deformations can occur when the stoplights switch, resulting in a momentary break of line voltage and/or repetitive on/off pulses due to contact bounce of the controlling relays. This would appear to D9 as standard line oscillations resulting in scrambled logic clock pulses and loss of the logic circuitry's control over SCR firing. Although the in-line components can handle a stray occurrence of such nature, repetitive and other worst case situations could create a problem.

The output of U1-G3 is pulses high at a phase angle of about 20 degrees, for approximately 6 mS. While it is high, it holds the set input of both flip-flops high. The primary purpose is to keep Q of U2-B latched high until just prior to desired reset point. Disturbances affecting this reset signal are now overridden by the pulsed duration of the set signal. This keeps the reset activated SCR trigger pulse to a minimum prematurity. The long pulsed set signal also keeps U1-A latched high, in turn keeping itself from being shortened. This double latching is necessary because the connection betWeen Q and K of U2-A would cause resetting of this flip-flop with the application of any clock pulse. Q and K are connected to free up a power-up situation where U2-A is stuck in a set state resulting in a lack of negative edges to trigger SCR1 firing pulses that also reset U2-A.

This double latched long pulse buffer adequately wipes out larger line deformations. Line disturbances of higher frequencies that would activate clock transitions are filtered out by capacitor C5.

INCLUSION OF VARIATIONS

There are many ways of flashing a strobe and charging a battery. The basic concept of this device is more valuable than any particular method of meeting the end goal.

The parts list calls for components of specific values. This description assumes that any changes of these values would not alter the principal design beyond the scope of the possible patent. For instance, a six or 24 volt battery could be used instead of the listed twelve volt battery. With this change the regulator of the battery charger and the tuning/power rating of the DC to DC converter would have to be changed. This does not change the basic concept of the design.

It will be appreciated that the instant invention incorporates a mounting of the components within the housing and utilizes a strobe light to obtain a high intensity light.

From the foregoing description it will become apparent that various designs are intended to fall within the scope of the following claims.

| SCHEMATIC PARTS LIST | |
|---|---|
| Battery | |
| B1 | Lead Acid Battery, 12 V |
| Capacitors | |
| C1 | Electrolytic, 220 uF 63 V |
| C2 | Electrolytic, 47 uF 15 V |
| C3 | Electrolytic, 100 uF 100 V |
| C4 | Ceramic, .01 uF |
| C5 | Mylar, .01 uF 100 V |
| C6 | Mylar, .1 uF |
| C7 | Mylar, .022 uF |
| C8 | Mylar, .047 uF |
| C9 | Electrolytic, 47 uF 50 V |
| C10 | Electrolytic, 1 uF 50 V |
| C11 | Electrolytic, 170 uF 330 V |
| C12 | Mylar, .047 uF 50 V |
| DIODES | |
| D1-D3 | 2.5 A 1000 PIV |
| D4 | IN4003 200 PIV 1 A |
| D5 | 10 V Zener 1 W |
| D6 | IN4003 |
| D7 | IN4742 12 V ± 5% Zener 1 W |
| D8 | IN4148F 50 V .1 A |
| D9 | 62 V Zener .5 W |
| D10 | IN4002 10C PIV 1 A |
| D11 | 43 V Zener 1 W |
| D12 | IN4003 |
| LAMPS | |
| DS1 | Argon Trigger Lamp, 200 V |
| DS2 | Xenon Discharge Flash Tube |
| FUSE | |
| F1 | 2 A 250 V Fast Acting |
| RELAY | |
| K1 | DPDT 24 VDC |
| INDUCTOR | |
| L1 | 500 uH Hash Choke |
| TRANSISTORS | |
| Q1-Q3 | 2N3904 |
| Q4 | A5A-2 |
| RESISTORS | |
| R1 | 3.9K 1 W |
| R2 | 1.8K |
| R3 | 1.5K |
| R4 | 180 ohm |
| R5 | 1 M |
| R6 | 1.5 5W |
| R7 | 500K ½ W Potentiometer |
| R8 | 22K |
| R9 | 56K |
| R10 | 560 ohm |
| R11 | 4.7K |
| R12 | 5.6K |
| R13 | NTC Thermistor, 10K @ 25 degrees C. |
| R14 | 390 ohm |
| R15 | 120K |
| R16 | 56K |
| R17 | 180K |
| R18 | 1 ohm ½ W |
| R19 | 10K |
| R20 | 150 ohm |
| R21 | 4.7M ½ W |
| R22 | 1 M ½ W |
| SWITCH | |
| S1 | SPDT, Slide |
| THYRISTOR | |
| SCR1 | 2N6396 |

-continued

| SCHEMATIC PARTS LIST | |
|---|---|
| TRANSFORMERS | |
| T2 | Trigger, 300 V Primary / 4 KV Secondary |
| T1 | Step Up, 3:2:98 |
| INTEGRATED CIRCUITS | |
| U1 | CD40106, CMOS Hex Schmitt Trigger |
| U2 | CD4027, CMOS Dual JK Flip-Flop |
| U3 | MOC3010, Triac Output Optocoupler |

What is claimed is:

1. For use in a conventional traffic signaling device comprising a series of lights sequentially energized from a conventional utility power source, means for supplanting said traffic signaling device upon failure of said utility power source comprising an independently powered lgiht source mounted within said signaling device including a xenon flash lamp, means for exciting said lamp comprising a capacitive energy storage device including a battery, a battery charging device, trigger means for discharging said capacitive energy storage device through said xenon flash lamp upon said capacitive energy storage device becoming sufficiently charged, a voltage sensor providing means for controlling the energization of an energy storage device charging means attendant upon the loss of resumption of full line voltage from said utility power source, and means for discharging said capacitive energy storage device through said xenon lamp comprising an argon filled tube operative as a fast high voltage switch connecting said capacitive energy storage device to said xenon lamp.

2. The invention according to claim 1, and a thyristor, a voltage sensitive circuit controlling said thyristor connected to said argon tube wherein said circuit energizes said thyristor upon sensing sufficient voltage within said capacitive energy storage device allowing said thyristor to ionize the argon within said argon tube rendering said argon conducting.

3. The invention according to claim 1, and a trigger means for initiating discharge of said energy storage device through said xenon lamp comprising a high voltage pulse circuit delivering an ionizing electrical pulse through said lamp attendant upon said energy storage device achieving a predetermined maximum charge allowing said energy storage device to discharge through said xenon lamp.

4. The invention according to claim 1, and a delay means providing a pre-determined delay between the cessation of conventional power input and the initiation of operation of said independently powered light source.

5. The invention according to claim 1, and a testing means comprising a device for manually initiating operation of said independently powered light source.

6. The invention according to claim 1, and a means for charging said capacitive energy storage device comprising:

a battery, a DC to AC convertor, a step-up transformer, and a rectifier wherein said capacitor charging means provides an output dependent upon the charge contained within said energy storage capacitor.

7. The invention according to claim 1, and a voltage sensing power sensor operative to initiate operation of said independently powered light source attendant on a drop in or cessation of full line voltage from said utility power source and ceasing operation of said independently power light source upon resumption of full line voltage from said utility power course.

8. The invention according to claim 1, and an auxiliary light assembly for a traffic control light device having at least one primary light comprising a bulb, a primary line voltage circuit of lighting the bulb, a xenon flash lamp strobe mounted in association with the bulb, a battery, an energy storage capacitor, a battery operated secondary circuit for cyclicaly charging said energy storage capacitor and discharging said capacitor through said xenon flash lamp strobe thereby flashing said strobe, an electronic voltage sensing device, means for connecting said battery to said cyclic capacitive charge-discharge circuit attendant on the output of said electronic voltage sensing device attached to said primary circuit, said voltage sensing device providing means for actuating said means for connecting said battery operating to disconnect said secondary circuit from said battery upon re-establishment of full line voltage in said primary circuit.

9. The invention according to claim 8, and said primary circuits including said primary light, and a voltage sensing device coupled with the primary circuit and primary light, a relay having a state determined by the output of said voltage sensing device, wherein said relay operates to connect said battery and secondary circuit in the event of a loss of full line voltage in said primary circuit, a battery charger functionally operative attendant upon the output of said voltage sensing device, an energy storage capacitor wherein said capacitor is cyclically charged by a battery operated circuit operative attendant to loss of full line voltage in said primary circuit, and a trigger means for creating a conducting path through said xenon flash lamp allowing said capacitor to discharge therethrough.

10. The invention according to claim 9, and a battery charging circuit operative attendant to the output of said voltage sensing device wherein said voltage sensing device energizes said battery charging circuit attendant upon the sensing device sensing full line voltage in said primary circuit.

11. The invention according to claim 10, and a capacitive energy storage device in said secondary circuit, and a trigger means for creating a conducting path in said xenon flash lamp so as to facilitate the discharge of said capacitive energy storage device through said xenon flash lamp.

12. The invention according to claim 11, and trigger means for creating a conducting path comprising a circuit for delivering a voltage pulse sufficient to ionize the xenon within said flash lamp.

13. The invention according to claim 1, wherein said conventional signaling device comprises at least one primary traffic light assembly including a primary circuit mounted within said device and having a primary bulb and a reflector therebehind, an energy storage capacitor operative to provide a capacitive discharge, a xenon flash lamp strobe driven by said capacitive discharge, means for mounting said strobe on said bulb, and means including a battery operated cyclic capacitive charge discharge circuit for periodically exciting said strobe attendant to power failure inactivating said primary circuit.

14. The invention according to claim 13, and said strobe being disposed in an axial alignment with said primary bulb for emitting rays of light essentially comparable to that of said primary bulb in substantially the same reflected array, said strobe affixed to said bulb by said mounting means comprising a clamp and located so as not to obscure said reflecting array.

15. The invention according to claim 13, and a battery-driven cyclically discharging capacitive energy storage means in circuit with said strobe, and means for activating said battery driven cyclically discharging capacitive energy storage means consequent to voltage loss in said bulb circuit.

* * * * *